United States Patent [19]

Hall, Sr.

[11] Patent Number: 4,766,269

[45] Date of Patent: Aug. 23, 1988

[54] FUSED TROLLEY SWITCH

[76] Inventor: Meryl M. Hall, Sr., HC 69, Box 76, Herndon, W. Va. 24726-9710

[21] Appl. No.: 2,426

[22] Filed: Jan. 12, 1987

[51] Int. Cl.[4] ..... H01H 85/00

[52] U.S. Cl. ..... 191/39; 191/38; 337/9

[58] Field of Search ..... 191/39, 38, 33 R; 200/15, 48 KB, 162; 337/4, 8, 9

[56] References Cited

U.S. PATENT DOCUMENTS

| | | | |
|---|---|---|---|
| 680,336 | 8/1901 | Linton | 337/9 |
| 751,084 | 2/1904 | Lowe | 337/9 |
| 822,237 | 6/1906 | Barkelew | 337/9 |
| 897,525 | 9/1908 | De Reamer | 337/9 |
| 1,253,761 | 1/1918 | Wolfsberg | 337/9 |
| 1,307,258 | 6/1919 | Johnston | 337/9 |
| 1,321,390 | 11/1919 | Pelletier et al. | 337/9 |
| 1,400,279 | 12/1921 | Freeman | 337/9 |
| 1,437,961 | 12/1922 | Conrad | 191/39 |
| 1,532,235 | 4/1925 | Dexter | 337/9 |
| 3,211,859 | 10/1965 | Kobryner | 337/9 |

*Primary Examiner*—Sherman D. Basinger
*Assistant Examiner*—Clifford T. Bartz
*Attorney, Agent, or Firm*—Clifford A. Poff

[57] ABSTRACT

A fused trolley line insulation switch for use in underground mine haulage systems. When opened, the switch allows isolation of down stream feeder cables and trolley line wire. When closed, the switch provides short circuit protection to the system by a fuse on the switch. The fuse is located on the blade member interconnecting the upstream system portion and the downstream system portion thereby allowing quick and safe replacement of the fuse after the occurence of a ground fault.

3 Claims, 1 Drawing Sheet

FUSED TROLLEY SWITCH

BACKGROUND OF THE INVENTION

1. Field of the Invention

The present invention relates generally to switches, and, more particularly, to a trolley wire insulator switch for use in underground mine haulage systems.

2. Description of the Prior Art

In underground mining operations, upon entry into the mine, long distances must frequently be traversed before reaching the mining area. In order to expedite transportation of personnel and equipment to and from the mining area, rail mounted vehicles are frequently employed.

Electrically operated mine vehicles which run on rails extending into the mine are typically powered by overhead trolley wires, through trolleys attached to the vehicles. The trolley moves along the trolley wire as the vehicle moves along the track thereby providing the electrically operated mine vehicle with a continuous supply of power. The power system is typically a DC system in which the trolley wires are biased with a positive potential, and the rails upon which the vehicles are mounted complete the DC circuit by acting as the ground connection.

The vehicles must be capable of transporting weights of several tons, and, therefore, must utilize heavy duty DC motors. Problems develop in such electrically-operated systems as the vehicles travel into the mine away from the DC power source since the current available for operation of the DC motor diminishes due to resistive losses of the trolley wire. To overcome this problem, in most mine haulage systems, high current capacity feeder cables are directly connected to the DC power source instead of the trolley wire. The feeder cables run in directions parallel to those of the trolley wires, but are of a greater diameter to provide the higher current capacity thereby. The trolley wires must be of a diameter to allow connection to the vehicle trolley, precluding any increase in the diameter of the trolley wire, thus limiting any increase in the current capacity of the trolley wire as the power requirements of the mining operation increases. By coupling the feeder cable to the trolley wire at periodic intervals, the current level required to operate the heavy duty DC motors may be maintained along the entire length of the trolley wire.

In such systems, the feeder cables are coupled to the trolley wires through section insulator switches. Such switches serve to couple both the feeder cable to a section of trolley wire and also to connect successive sections of trolley wires and feeder cables. The switches allow manual openings thereof in order to disconnect the system downstream of the switch when not needed, such disconnection being desired for safety reasons.

A modular section insulator switch is disclosed in U.S. Pat. No. 4,365,129. The switch described therein allows connection of feeder cables of different diameters thereto. Reuse of such a switch is therefore allowed when larger diameter feeder cables are installed in a mine haulage system to increase the current carrying capacity thereby as mining operations expand in the mine.

Also known in the art are provisions to include fuses in the section insulator switches as a safety measure in the event of a fault along a section of trolley wire. In existing switches containing such fuses, however, the fuse is located in the body of the switch in close proximity to the high current feeder cables. Replacement of a fuse from such a location is therefore a potentially hazardous task.

Accordingly, it is the object of the present invention to provide a fusible-trolley-insulation switch in which the fuse is located such that it may be quickly and safely replaced after the occurrence of a ground fault.

SUMMARY OF THE PRESENT INVENTION

In accordance with the present invention, a trolley wire section insulator switch includes a nonconductive base and a first and second connecting means attached thereto for connecting a first and second trolley line wire to the switch. A blade member is pivotally and removably attached to the first connecting means allowing the blade member to be moved from a closed position in which the blade member contacts with the second connecting means, to an open position in which the blade member is out of contact with the second connecting means. The blade member contains a non-conductive cavity in the central portion thereof suitable for insertion of a fuse therein. The fuse thereby allows the first connecting means to be electrically connected to the second connecting means when the blade member is in the closed position.

In a further embodiment of the present invention, a first feeder cable connecting means is attached to the non-conductive base and electrically coupled to the first connecting means to electrically couple the first feeder cable to the first trolley wire.

In a still further embodiment of the present invention, a second feeder cable connecting means is attached to the non-conductive base and electrically coupled to the second connecting means to electrically couple the second feeder cable to the second trolley wire.

BRIEF DESCRIPTION OF THE DRAWINGS

The invention may be better understood and further advantages and uses thereof more readily apparent when considered in view of the following detailed description of exemplary embodiments taken with the accompanying drawings in which.

DESCRIPTION OF THE PREFERRED EMBODIMENT

Figure 1:
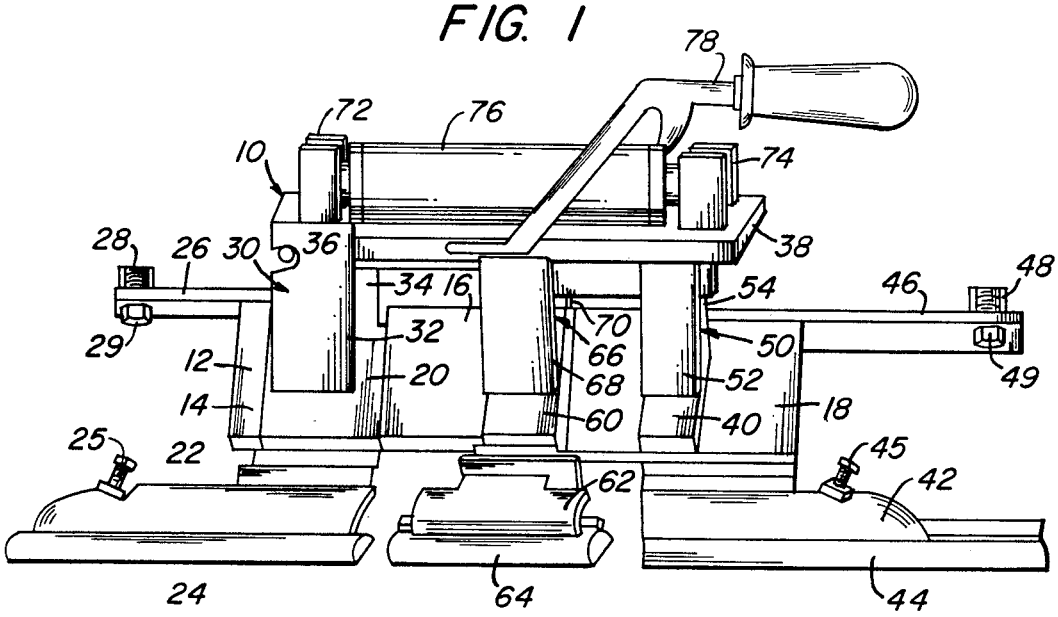
FIG. 1 is an elevational view of the trolley line insulation switch of the present invention in which the switch is in the closed position.

Referring now to the illustration of FIG. 1, there is shown the fused trolley line insulation switch of the present invention shown generally as 10. A generally-rectangular non-conductive base 12 is positioned such that the longitudinal axis thereof runs in a direction substantially parallel to the direction of travel of the trolley vehicles (not shown) through a mine shaft. The latitudinal axis of base 12 runs in a direction substantially perpendicular to the plane of the floor of the mine shaft. The base 12 may be divided into a left side portion 14, a central portion 16, and a right side portion 18. Attached to a first surface of left portion 14 of the base 12 is a conductive plate 20 which extends across the width of the base 12 and is attached thereto by any suitable attaching means such as, for example, by rivets extending through appropriately positioned bore holes in the base 12. One end of plate 20 extends beyond the width of base 12 to extend to a downwardly projecting left trolley runner 22. The runner is jaw-shaped with the spacing between the jaws being such as to allow insertion of an end of a left trolley wire 24 therebetween. A clamp-down bolt 25 extends through the runner 22 to clamp the wire 24 in position once inserted.

A second end of plate 20 also extends beyond the width of base 12 to extend to a left-feeder cable connecting bar 26. Bar 26 contains an upstanding U-shaped connecting means 28 at the end thereof to allow insertion of an end of a feeder cable therethrough. A clamp-down bolt 29 extends through the bar 26 and into the cavity defined by the connecting means 28. When a feeder cable is attached to bar 26 and trolley wire 24 is clamped to trolley runner 22, plate 20 provides an electrical connection therebetween.

Outwardly projecting jaw 30 consisting of two conductive plates 32 and 34 extend out from plate 20 and are connected by through bolt 36. When positioned for use in the mine haulage system, plates 32 and 34 extend outwardly in plane substantially parallel to that of the mine shaft floor. Also positioned between plates 32 and 34 is the proximal end of T-shaped blade member 38. The "top" of the T of blade member 38 defines the separation distance between the plates 32 and 34. Through bolt 36 extends through a bore hole in the "tail" portion of the T of blade member 38, and also through slotted hole 39 of plate 32 and through a slotted hole (not shown) of plate 34, thereby causing the blade member 38 to be pivotally attached to the jaw 30, but removable therefrom.

Attached to the first surface of the right portion 18 of the base 12 is a conductive plate 40 which extends across the width of the base 12 and is attached thereto by any suitable attaching means such as, for example, by rivets extending through appropriately positioned bore holes in the base 12. One end of plate 40 extends beyond the width of base 12 to extend to a downwardly projecting right trolley runner 42. Similar to left trolley runner 22, the runner 42 is jaw shaped with the spacing between the jaws being such as to allow insertion of an end of right trolley wire 44 therebetween. A clamp-down bolt 45 extends through the runner 42 to clamp the wire 44 in position once inserted.

A second end of plate 40 also extends beyond the width of base 12 to extend to a right feeder cable connecting bar 46. Bar 46 contains an upstanding U-shaped connecting means 48 at the end thereof to allow insertion of an end of a feeder cable therethrough. A clamp-down bolt 49 extends through the bar 46 and into the cavity defined by the connecting means 48. When a feeder cable is attached to bar 46 and trolley wire 44 is clamped to trolley runner 42, plate 40 provides an electrical connection therebetween.

Outwardly projecting jaw 50 consisting of two conductive plates 52 and 54 extend out from plate 40. Plates 52 and 54 extend outwardly in planes substantially parallel to the planes defined by plates 32 and 34. Also positioned between the plates 52 and 54 is the distal end of T-shaped blade member 38. The vertical portion of the T defines the separation distance between the plates 52 and 54.

Also included in the preferred embodiment is central metallic plate 60 attached to the first surface of the central portion 16 of the base 12. Plate 60 extends across the width of the base 12 and is attached thereto by any suitable attaching means such as, for example, by rivets extending through appropriately positioned bore holes in the base 12. A first end of plate 60 extends beyond the width of base 12 to extend to a downwardly projecting central trolley runner 62. The runner is jaw shaped with the spacing between the jaws being such as to allow a portion of central trolley wire 64 to be clamped therebetween. Trolley wire 64 is of a length substantially bridging the gap between the ends of the left and right trolley wires 24 and 44. Conductive plate 65 connects plate 20 to plate 40 thereby electrically coupling plate 20 to plate 40. The function thereof is to prevent arcing of current when a vehicle trolley passes in the gap that otherwise would be present between the wires.

Outwardly projecting jaw 66 consisting of two conductive plates 68 and 70 extend out from plate 60. The "tail" of the T of blade member 38 defines the separation distance between plates 68 and 70. When T-shaped blade member 38 is pivoted about through bolt 36 such as to contact with plate 68 and 70, the jaw 66 thereby acts to support the blade member 38.

Blade member 38 is non-conductive in the central portion thereof and is only electrically conductive at the proximal and distal portions to provide electrical contact with jaws 30 and 50, respectively.

Attached to and outwardly extending from the blade member 38 at the electrically conductive proximal and distal portions are left fuse jaw 72 and right fuse jaw 74, respectively. Jaws 72 and 74 are comprised of an electrically-conductive material and function as a fuse-holding means for fuse 76. Fuse 76 may be of any conventional design, and rated for any desired current level.

Insulated handle member 78 is attached to the non-conductive central portion of blade member 38 in order to allow an operator to pivot the blade member 38 around through bolt 36 so as to allow the blade member 38 to be placed in contact with jaw 50 and placed out of contact with jaw 50.

Upon installation, the trolley line insulator switch 10 functions to electrically isolate sections of trolley line in branch lines and side tracks in underground mine haulage systems, and also to provide short circuit protection along those lines. The switch 10 may be used in both systems using feeder cables and trolley lines and in systems using trolley lines only. The switch is further adaptable to allow continued use of the switch even as the power system requirements change. Feeder cables may be replaced to allow system expansion requiring feeder cables in greater diameters to allow higher current capacities, and short circuit protection for the new system may be maintained by merely replacing the fuse located thereon.

When the blade member 38 is out of contact with jaw 50, there is no current in the right side portion of the switch 10, and no current is allowed downstream of the open switch. The left feeder cable is electrically coupled to only the left trolley wire 24 through left metallic plate 20. When the blade member 38 is caused to contact with jaw 50, there is provided an electrical connection between the left portion of the switch and the right portion of the switch. Right trolley wire runner 42 and right feeder cable bar 46 are electrically coupled to the left feeder cable car 28 due to the fact that the left metallic plate 20, jaw 31, left fuse jaw 72, fuse 76, right fuse jaw 74, jaw 51, and right metallic plate 40 may all be simultaneously electrically coupled to one another.

Figure 2:
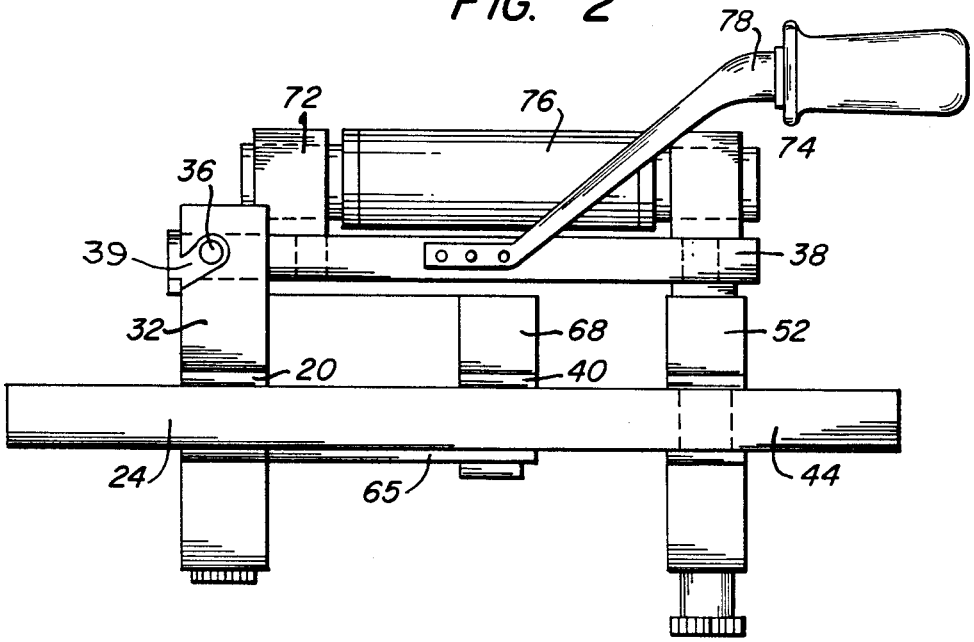
FIG. 2 is a bottom view of the switch of FIG. 1 illustrating the position of the fuse as it would appear to an operator situated beneath the switch.

Shown in FIG. 2 is a bottom view of the switch 10 in the "closed" position. A downstream short circuit causing a serge of current in the system causes the fuse 76 to "blow", thereby opening the circuit. Because the slotted holes on plates 32 and 34 through which through bolt 36 extends allows blade member 38 to be removed from the jaw 30, the fuse 76 may be quickly and safely replaced upon correction of the cause of the fault, and the blade member 38 with the new fuse may be repositioned on the jaw 30.

While the present invention has been described in connection with the preferred embodiment shown in FIGS. 1 and 2, it is understood that other similar embodiments may be used or modifications and additions may be made to the described embodiment for performing the same function of the present invention without deviating therefrom. Therefore, the present invention should not be limited to any single embodiment but rather construed in breadth and scope in accordance with the recitation of the appended claims.

I claim as my invention:

1. A trolley wire section insulator for connecting a trolley wire section to a feeder cable, including:

a non-conductive base;

first trolley wire connecting means for connecting a first trolley wire to said base;

first feeder cable connecting means for connecting a first feeder cable to said base;

first inter-connecting means for electrically connecting said first feeder cable connecting means to said first trolley wire connecting means;

second trolley wire connecting means for connecting a second trolley wire to said base;

second feeder cable connecting means for connecting a second feeder cable to said base;

second inter-connector means for electrically connecting said second feeder cable connecting means to said second trolley wire connecting means;

a blade member comprising an electrically conductive proximal portion, an electrical conductive distal portion, and a central portion, said proximal portion being pivotally connected to said first trolley wire connecting means, allowing said blade member to be moved from a closed position wherein said distal portion is in contact with said second trolley wire connecting means to an open position wherein said distal portion is out of contact with said second trolley wire connecting means, and wherein said central portion contains an electrically non-conductive cavity; and a fuse positioned in said cavity for allowing an electrical connection to be maintained between said first trolley wire and said second trolley wire when said blade member is in the closed position.

2. The trolley-wire section-insulator of claim 1 wherein said blade member is removable from the first trolley wire connecting means.

3. The trolley wire section insulator of claim 1 further including a handle means protruding from said blade member.

* * * * *